US008757114B2

(12) United States Patent
Hoppe et al.

(10) Patent No.: US 8,757,114 B2
(45) Date of Patent: Jun. 24, 2014

(54) CONTROL VALVE FOR CONTROLLING PRESSURE-MEDIUM FLOWS COMPRISING AN INTEGRATED CHECK VALVE

(75) Inventors: Jens Hoppe, Erlangen (DE); Lars Buchmann, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 240 days.

(21) Appl. No.: 13/322,966

(22) PCT Filed: May 6, 2010

(86) PCT No.: PCT/EP2010/056148

§ 371 (c)(1),
(2), (4) Date: Nov. 29, 2011

(87) PCT Pub. No.: WO2010/139522

PCT Pub. Date: Dec. 9, 2010

(65) Prior Publication Data

US 2012/0073535 A1 Mar. 29, 2012

(30) Foreign Application Priority Data

Jun. 5, 2009 (DE) ..... 10 2009 024 026

(51) Int. Cl.
*F01L 1/34* (2006.01)

(52) U.S. Cl.
USPC ..... 123/90.17; 137/625.25

(58) Field of Classification Search
USPC ..... 123/90.15, 90.17; 464/160, 161; 137/599.18, 625.26, 625.67, 625.68
See application file for complete search history.

(56) References Cited

U.S. PATENT DOCUMENTS 3,882,891 A * 5/1975 Viles et al. ..... 137/512.15
7,240,768 B2 * 7/2007 Sageman ..... 181/237

(Continued)

FOREIGN PATENT DOCUMENTS

DE 19616973 11/2003
DE 19727180 12/2003

(Continued)

*Primary Examiner* — Thomas Denion
*Assistant Examiner* — Daniel Bernstein
(74) *Attorney, Agent, or Firm* — Volpe and Koenig, P.C.

(57) ABSTRACT

A control valve for controlling pressure medium flows, including: a valve housing having a hollow construction and having at least one feed connection, at least two working connections, and at least one discharge connection; a control piston held displaceably inside the valve housing, through which, dependent on position, the feed connection can be connected via at least one pressure medium line to the one or to the other working connection, while the respectively other working connection is connected via at least one second pressure medium line to the discharge connection. The control piston has a piston cavity and the first pressure medium line includes a feed opening allocated to the feed connection and a discharge opening allocated to the working connections, with each of these openings opening into the piston cavity. At least one check valve that can be hydraulically opened and that releases the first pressure medium line in the feed direction is provided, having a closing part that has a sealing surface, by which part a valve opening can be closed. The control valve has an elastically deformable closing part, such that the sealing surface thereof is movable, through elastic deformation of the closing part, into a closed position in which it lies against the valve opening in sealing fashion and an open position in which the valve opening is completely open, one of the openings of the control piston acting as valve opening. Alternatively, the closing part is mounted resiliently via at least one spring tongue.

14 Claims, 8 Drawing Sheets

(56) References Cited

U.S. PATENT DOCUMENTS

| | | | | |
|---|---|---|---|---|
| 7,487,752 | B2 * | 2/2009 | Strauss et al. | 123/90.17 |
| 7,600,531 | B2 * | 10/2009 | Patze et al. | 137/512.15 |
| 7,954,467 | B2 * | 6/2011 | Grunow | 123/90.17 |
| 8,127,790 | B2 * | 3/2012 | Van Weelden et al. | 137/550 |
| 8,316,889 | B2 * | 11/2012 | Hoppe et al. | 137/625.68 |

FOREIGN PATENT DOCUMENTS

| | | |
|---|---|---|
| DE | 102005013085 | 6/2006 |
| EP | 1291563 | 3/2003 |
| EP | 1447602 | 8/2004 |
| EP | 1596041 | 11/2005 |
| WO | 2007031866 | 3/2007 |

* cited by examiner

CONTROL VALVE FOR CONTROLLING PRESSURE-MEDIUM FLOWS COMPRISING AN INTEGRATED CHECK VALVE

BACKGROUND

The present invention is in the technical area of internal combustion engines, and relates in its category to a control valve for controlling pressure medium flows, having an integrated check valve.

In internal combustion engines having mechanical valve control, gas exchange valves are actuated by a camshaft driven by a crankshaft, the control times of the gas exchange valves are definable via the arrangement and shape of the cams. The use of special devices for the optional modification of the phase position between the crankshaft and the camshaft, generally known as "camshaft adjusters," has long been known. Through the use of camshaft adjusters, the control times of the gas exchange valves can be influenced in a targeted manner as a function of the momentary operating state of the internal combustion engine, and in this way a number of advantageous effects, such as reduced fuel consumption and reduced production of pollutants, can be achieved.

In general, camshaft adjusters comprise a drive part, which stands in driven connection with the crankshaft via a drive wheel, and an output part connected fixedly to the camshaft, as well as an adjustment mechanism, connected between the drive part and the output part, that transmits the torque from the drive part to the output part and enables an adjustment and fixing of the relative rotational position between the two. In hydraulic camshaft adjusters, the adjustment mechanism comprises at least one pressure chamber pair whose members act against one another, via which the rotational position between the drive part and the output part can be adjusted or fixed by charging the pressure chambers with pressure medium.

As a rule, hydraulic adjustment mechanisms comprise an electronic control device that regulates the inflow and outflow of pressure medium on the basis of acquired characteristic data of the internal combustion engine, using an electromagnetically activated control valve. In a typical design, the control valves have a cylindrical valve housing and a control piston that is axially displaceable inside the valve housing, the piston being displaceable by an electromagnetically movable tappet against the spring force of a resetting spring element. Such control valves are well known, and are described in detail for example in German patent DE 19727180 C2, German patent DE 19616973 C2, and European patent application EP 1 596 041 A2 of applicant.

Mechanically actuated gas exchange valves are as a rule held in the closed position by valve pressure springs. This has the result that when the gas exchange valves are actuated, during opening the cams are pressed opposite the direction of rotation of the camshaft, and during closing they are pressed in the direction of rotation of the camshaft, by the valve springs. Thus, during operation of the internal combustion engine alternating moments occur at the camshaft that can be introduced, as pressure peaks or pulsations, into the pressure medium circuit of the hydraulic adjustment mechanism of the camshaft adjuster. If additional hydraulic components are connected to the pressure medium circuit, these pressure peaks can cause these components to be adversely affected or damaged.

In order to prevent this, it is known to provide check valves in the pressure medium paths of hydraulic camshaft adjusters, which valves block the return flow of pressure medium to the pressure medium pump. The check valves, typically ball check valves, can in particular be integrated in the control valve.

A control valve of the type described having an integrated check valve is described for example in the above-named European patent application EP 1 596 041 A2 of applicant.

SUMMARY

Against this background, the object of the present invention is to further develop a control valve of the type described, having an integrated check valve, in an advantageous manner.

According to the proposal of the present invention, these and further problems are solved by control valves having the features of the independent patent claims. Advantageous embodiments of the present invention are indicated by the features in the dependent claims.

According to the present invention, control valves are provided for controlling pressure medium flows, in particular for devices for modifying the control times of an internal combustion engine.

In accordance with its type, the control valve for controlling pressure medium flows has a valve housing having a hollow construction, having at least one feed connection, at least two working connections, and at least one discharge connection, as well as a control piston held displaceably inside the cavity of the valve housing, by which, dependent on its position, the feed connection is connectable via at least one first pressure medium line to the one or the other working connection, while the respective other working connection is connected via at least one second pressure medium line to the discharge connection. The valve housing and the control piston can each be made cylindrical, the control piston is held in axially displaceable fashion inside the valve housing.

The control piston is provided with a piston cavity, the first pressure medium line comprising a feed opening allocated to the feed connection and a discharge opening allocated to the two working connections, each of which opens into the piston cavity. The feed opening and discharge opening of the control piston can in particular be realized as radial openings.

In addition, the control valve comprises at least one check valve that releases the first pressure medium line in the feed direction and that can be hydraulically opened. The check valve is provided with a closing part that has a sealing surface, and at least one valve opening being tightly closable by the closing part, or the sealing surface thereof.

According to a first aspect of the present invention, the control valve according to the present invention is essentially distinguished in that the closing part is elastically deformable, and its sealing surface is movable, through elastic deformation of the closing part, into a closed position in which it lies tightly against the valve opening, and into an open position in which the valve opening is completely open. Here, the feed opening or discharge opening of the control piston acts as valve opening.

According to the first aspect of the invention, the control valve according to the present invention enables a particularly simple and economical technical realization of the check valve.

In an advantageous embodiment of the control valve according to the present invention according to the first aspect of the invention, the elastically deformable closing part is realized in the form of a band wound in spiral fashion to form a cylindrical body, an outer surface of the closing part acting as sealing surface.

According to a second aspect of the present invention, the control valve of the type described is essentially distinguished in that the closing part is mounted in elastically resilient fashion by at least one spring tongue, the sealing surface being movable, through elastic deformation of the spring tongue, into a closed position in which it lies tightly against the valve opening, and into an open position in which the valve opening is completely open. Here, the feed opening or discharge opening of the control piston acts as valve opening.

According to the second aspect of the invention, the control valve according to the present invention enables a particularly simple and economical technical realization of the check valve.

In an advantageous embodiment of the control valve according to the present invention according to the first or second aspect of the invention, the closing part is located in the piston cavity, the feed opening of the control piston acting as valve opening. In this case, in particular an inner casing surface of the piston cavity can act as valve seat for the closing part, for the tight closing of the valve opening by the sealing surface of the closing part. This measure enables a particularly simple technical realization of the check valve.

In a further advantageous embodiment of the control valve according to the present invention, according to the first or second aspect of the invention at least one insert part suitable for the axial bearing of the closing part is located in the piston cavity. Through this measure, the closing part can be axially mounted in reliable and secure fashion, and in particular even given a strong elastic deformation or a particularly large opening stroke.

In a further advantageous embodiment of the control valve according to the present invention, according to the first or second aspect of the invention the at least one insert part is provided with a means for limiting the opening stroke of the closing part. Through this measure, the opening stroke can be limited, for example in order to influence in a targeted manner the responsiveness or switching times of the check valve.

In a further advantageous embodiment of the control valve according to the present invention, according to the first or second aspect of the invention at least one support part is integrally formed on the closing part for the axial support of the closing part on the control piston. Through this measure, an axially fixed support of the closing part can easily be realized.

In a further advantageous embodiment of the control valve according to the present invention, according to the first or second aspect of the invention the closing part is mounted by the at least one support part on wall segments of the control piston that are located opposite one another. Through this measure, an axially fixed support of the closing part can easily be realized.

In a further advantageous embodiment of the control valve according to the present invention, according to the first or second aspect of the invention the closing part is located on an outer casing surface of the control piston, and the discharge opening of the control piston acts as valve opening.

In a further advantageous embodiment of the control valve according to the present invention, according to the first or second aspect of the invention the closing part is made of spring steel sheet, and the closing part is easily producible in industrial series production. The sheet thickness of the spring steel sheet is for example in the range from 0.05-0.15 mm, the opening and closing characteristic of the check valve can be influenced in a targeted manner via this thickness.

The above-noted embodiments of the control valve according to the present invention can be combined with one another, and further advantageous effects may be achieved by such combination.

In addition, the present invention extends to a device for modifying the control times of an internal combustion engine having a hydraulic adjustment mechanism provided with a control valve as described above. A possible embodiment of the device for modifying the control times is a rotary piston adjuster having an outer rotor that can be brought into driven connection with a crankshaft and having an inner rotor that can be connected to a camshaft so as to fixedly co-rotate therewith, said inner rotor being mounted concentrically relative to a common axis of rotation, and in rotationally adjustable fashion relative to the outer rotor, and its position of angular rotation relative to the outer rotor being adjustable via a hydraulic positioning mechanism that comprises at least one pressure chamber pair whose members act against one another.

In addition, the present invention extends to an internal combustion engine having at least one such device for modifying the control times of an internal combustion engine.

BRIEF DESCRIPTION OF THE DRAWINGS

The present invention is now explained in more detail on the basis of exemplary embodiments, with reference to the accompanying drawings. Identical or identically functioning elements are designated in the drawings by the same reference characters.

DETAILED DESCRIPTION OF THE PREFERRED EMBODIMENTS

Figure 1:
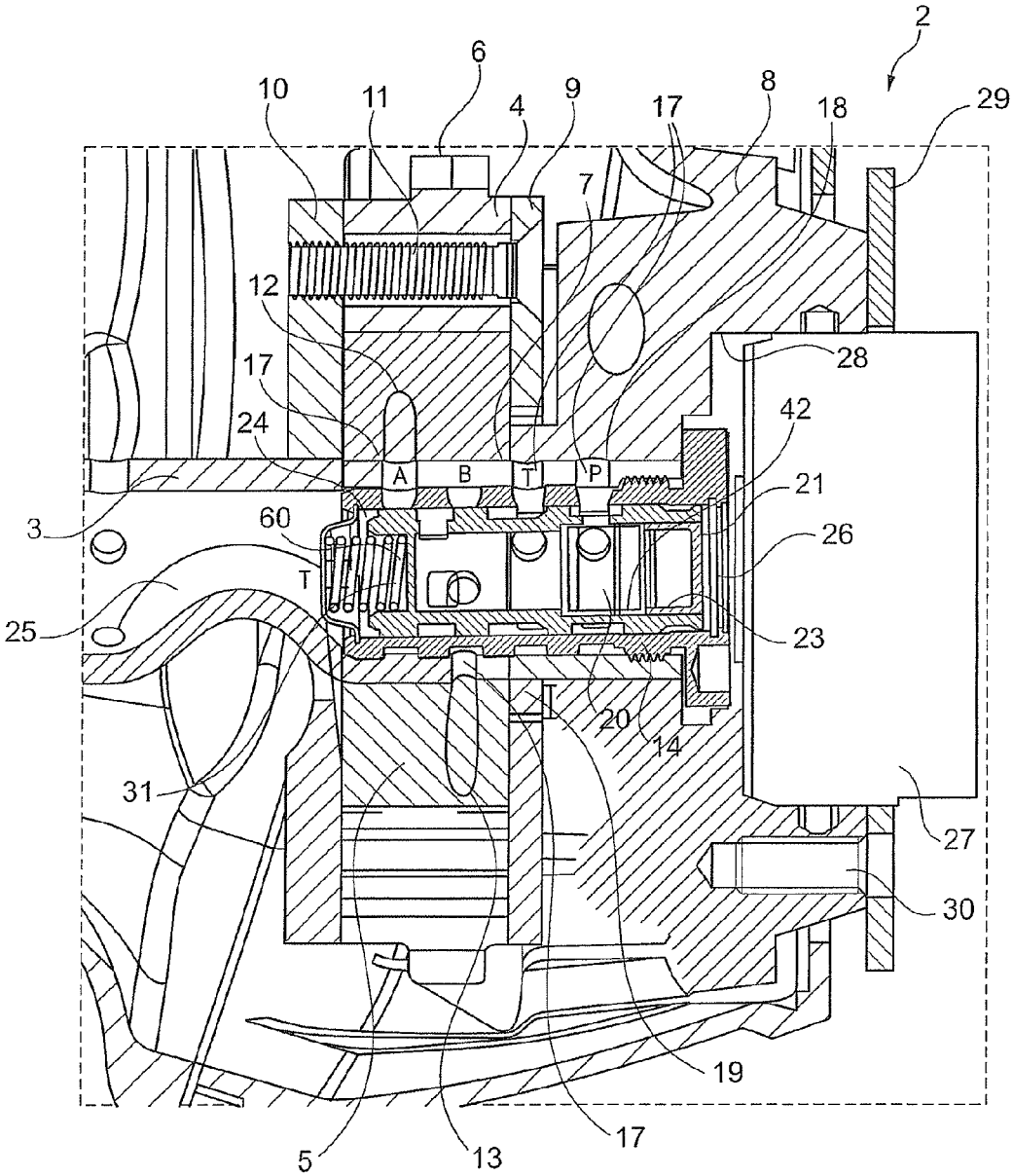
FIG. 1 is a schematic axial sectional view of a hydraulic rotary piston adjuster having a control valve according to a first exemplary embodiment of the present invention.

First, a first exemplary embodiment of the control valve according to the present invention is explained with reference to FIGS. 1 through 3. A control valve 1 is part of a hydraulic adjusting mechanism for controlling a hydraulic rotary piston adjuster, designated as a whole by reference character 2, of an internal combustion engine.

The rotary piston adjuster 2 comprises an outer rotor 4 that stands in driven connection with a crankshaft (not shown), and comprises an inner rotor 5 fixedly connected to a camshaft 3 so as to co-rotate therewith, the outer rotor and inner rotor being situated concentrically relative to a common axis of rotation of the camshaft 3. The outer rotor 4 is rotationally coupled to the crankshaft via a chain wheel 6 and a chain drive (not shown). It would also be conceivable to accomplish the drive connection of the outer rotor 4 to the crankshaft via a belt drive or gear drive. The outer rotor 4 is mounted in rotationally adjustable fashion on the inner rotor 5. The inner rotor 5 has a central bore (not shown in more detail) through which there passes the camshaft 3, which is connected via a weld seam 7 to inner rotor 5 fixedly so as to co-rotate therewith. It would also be conceivable to connect the inner rotor 5 to the camshaft 3 by some other fastening technique. The camshaft 3 is rotatably mounted on a cylinder head 8 of the internal combustion engine in a standard manner not shown in more detail.

In the space radially intermediate between the outer rotor and the inner rotor 4, 5, the outer rotor 2 forms a plurality of pressure compartments that are distributed in the circumferential direction, into each of which a respective vane connected to the inner rotor 5 extends. The vanes divide each of the pressure compartments into a pair of first and second pressure chambers (pressure chambers A, B) that act against one another; this is not shown in more detail in the Figures. The outer rotor 4 forms a pressure-tight housing, the pressure chambers being axially sealed in pressure-tight fashion by two side plates 9, 10 located at the ends. The two side plates 9, 10 are screwed together by a multiplicity of axial fastening screws 11 that are uniformly distributed in the circumferential direction.

The control valve 1 for the pressure medium controlling of the rotary piston adjuster 2 is inserted into a camshaft cavity at an end segment of the camshaft 3. The rotary piston adjuster 2 is provided with first and second pressure lines 12, 13 that can optionally be connected fluidically either to a pressure medium pump or to a pressure medium outlet, via the control valve 1. The first and second pressure lines 12, 13 are here realized for example as radial bores of the inner rotor 5, extending from the central bore of said rotor to an outer casing surface. The first pressure lines 12 open into the first pressure chambers (pressure chambers A), and the second pressure lines 13 open into the second pressure chambers (pressure chambers B). If for example the pressure chambers A are charged with pressure medium, their chamber volumes increase at the expense of the pressure chambers B, in order in this way to cause the outer rotor 4 to rotate in the one direction of rotation relative to the inner rotor 5. Correspondingly, the two rotors can be displaced in the other direction of rotation if the pressure chambers B are charged with pressure medium. Likewise, a position of angular rotation between the outer rotor and inner rotor 4, 5 can be hydraulically clamped, for example by simultaneously separating the pressure chambers A, B both from the pressure medium pump and from the pressure medium outlet.

The precise design and functioning of a hydraulic rotary piston adjuster are known to those skilled in the art, for example from the above-named prior art document, so a more detailed description here is not necessary.

The control valve 1 comprises a valve housing 14 essentially made in hollow cylindrical fashion, having a radial pressure medium connection P (referred to in the introduction to the description as a "feed connection"), a radial tank connection $T_1$ (referred to as a "discharge connection" in the introduction to the description), two radial working connections A, B, and an axial tank connection $T_2$ (referred to as a "discharge connection" in the introduction to the description). The radial connections A, B, $T_1$, and P are fashioned as first annular grooves 15 located axially at a distance from one another, made in an outer casing surface 51 of a valve housing 14. The first annular grooves 15 are each provided with first openings 16 that open into a housing cavity 24 formed by the valve housing 14. Through-holes 17 of the camshaft 3 are allocated to each of the first annular grooves 15, so that the two working connections A, B can communicate with the first and second pressure lines 12, 13, and the radial discharge connection $T_1$ can communicate with a first discharge channel 19, made in a cylinder head 8, for connection with a pressure medium tank, and the pressure medium connection P can communicate with a pressure medium channel 18, made in the cylinder head 8, for connection with a pressure medium pump. The housing cavity 24 is fluidically connected to a second discharge channel 25, formed by the camshaft 3, for connection to the fluid medium tank.

The control valve 1 comprises an essentially cylindrical control piston 20 that is arranged to be axially displaceable inside the housing cavity 24 of the valve housing 14. The control piston 20 is made in the form of a hollow piston having a piston cavity 22. One axial end (the right axial end in FIG. 1) of the piston cavity 22 is limited in pressure-tight fashion by a first wall segment 21. The first wall segment 21 is formed by a cup-shaped pressure piece 23 placed into the piston cavity 22. It would also be conceivable to realize the first wall segment 21 in one piece with the control piston 20. The opposite axial end (the left axial end in FIG. 1) of the piston cavity 22 is limited in pressure-tight fashion by a second wall segment 60.

On the first wall segment 21 of the control piston 20, a tappet 26 engages that is rigidly fastened to a magnetic armature (not shown) of an electromagnet 27. The electromagnet 27 is partly accommodated in a recess 28 of the cylinder head 8, and is connected to the cylinder head 8 via a flange 29 by axial fastening screws 30. When current flows to the magnetic armature of the electromagnet 27, the tappet 26 is axially displaced, and thereby displaces the control piston 20 in the axial direction against the spring force of a helical pressure spring 31. For this purpose, the helical pressure spring 31 is supported with its one end on a first annular step 32 of the second wall segment 60, and is supported with its other end on a second annular step 33 of the valve housing 14. If current is not supplied to the magnetic armature, the helical pressure spring 31 resets the control piston 20 to its initial position (to the right in FIG. 1).

A second, third, and fourth annular groove 34, 35, 36 are made in an outer casing surface 50 of the control piston 20. The second and third annular grooves 34, 35 communicate with the piston cavity 22 via the second and third openings 37, 38 respectively. Here, the second annular groove 34 is made such that in each position of the control piston 20 relative to the valve housing 14, it communicates with the first openings 16 of the first annular groove 15 of the pressure medium connection P. The third annular groove 35 is made such that, depending on the position of the control piston 20, it communicates either with the first openings 16 of the first annular groove 15 of working connection A, or with the first openings 16 of the first annular groove 15 of working connection B. The second annular groove 34 and the second openings 37 are referred to in the introduction to the description as "feed opening." The third annular groove 35 and the third openings 38 are referred to in the introduction to the description as "discharge opening." The fourth annular groove 36 is made such that, depending on the position of the control piston 20, it either communicates both with the first openings 16 of the first annular groove 15 of the working connection B and with the first openings 16 of the first annular groove 15 of the radial discharge connection $T_1$, or communicates only with the first openings 16 of the first annular groove 15 of the radial discharge connection $T_1$.

In the piston cavity 22 there is placed an elastically deformable closing part 42 that cooperates with an inner casing surface 39 of the control piston 20 in such a way that a check valve 43 for the pressure medium connection P is formed. For this purpose, the closing part 42 is held in axially captive fashion between a third annular step 40 formed by the inner casing surface 39 and a fourth annular step 41 formed by the end face of the pressure piece 23. The closing part 42, which is made essentially cylindrical, is formed from a spirally wound band of spring steel sheet, and is situated coaxially relative to the control piston 20 in such a way that its outer surface 61 covers the two openings 37 of the second annular groove 34 ("feed opening"). The second openings 37 here act as valve openings of the check valve 43. A segment, located between the third and fourth annular step 40, 41, of the inner casing surface 39 of the control piston 40, into which the second openings 37 open, here acts as a valve seat for the closing part 42, and the outer surface 61, acting as a sealing surface, of the closing part 42 lies tightly against the inner casing surface 39 of the control piston 20.

Figure 2A:
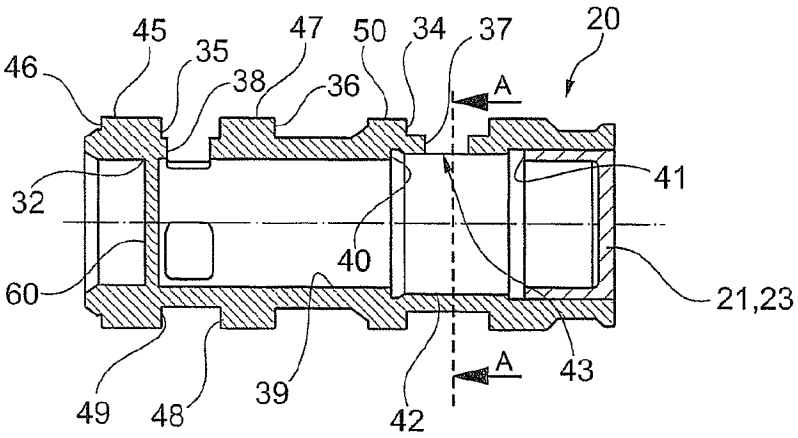
FIGS. 2A-2D are various views of the control piston of the control valve of FIG. 1, with open and closed check valve.
Figure 2B:
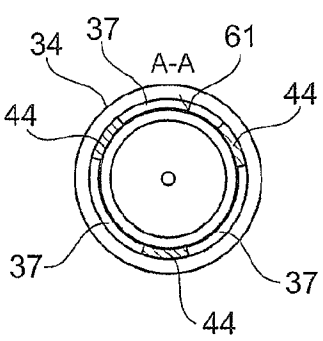
Figure 2B:
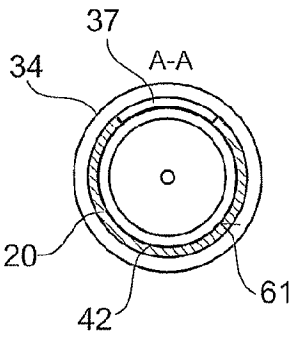

FIGS. 2A and 2B, which show an axial sectional view of the control piston 20 and a radial sectional view along sectional line A-A, illustrate a situation in which the outer surface 61 of the closing part 42 lies tightly against the inner casing surface 39 of the control piston 20. Accordingly, the closing part 42 is in a closed position for the directed blockage of the flow of pressure medium to the pressure medium connection P (i.e., opposite the direction for conveying pressure medium to the working connections A, B).

FIG. 2B shows a first variant of the control piston 20, comprising three axial piston webs 44 having three second openings 37, distributed in the circumferential direction, and comprising a second annular groove 34. FIG. 2B' shows a second variant of the control piston 20, comprising only a single second opening 37 and a second annular groove 34.

The closing part 42, spirally wound in the shape of a band, can be elastically deformed when charged with pressure medium through the pressure medium connection P, so that, for hydraulic opening, it lifts a check valve 43 from its sealing seat. When charged with pressure medium, the closing part 42 is further spirally wound, reducing its diameter (constricting radially). For this purpose, the elastic properties of the closing part 42, made of spring steel sheet, are adapted to the pressures present at the pressure medium connection P. The thickness of the material of the spring steel sheet is for example in the range from 0.05 to 0.15 mm.

Figure 2C:
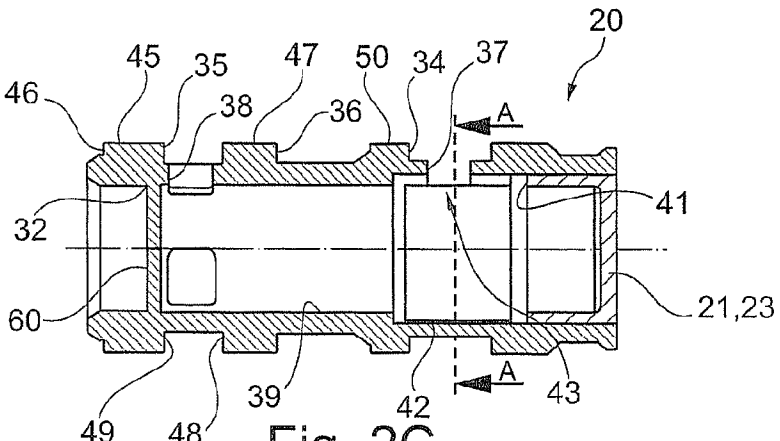
Figure 2D:
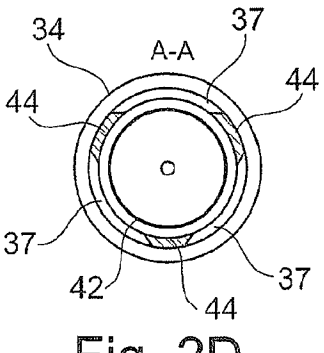
Figure 2D:
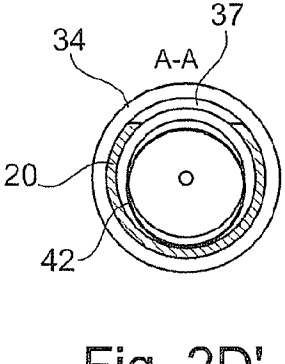

FIGS. 2C and 2D, which show an axial sectional view of the control piston 20 and a radial sectional view along sectional line A-A, illustrate a situation in which the closing part 42 is lifted off from the inner casing surface 39 through the action of pressure medium. Here, the closing part 42 is in an open position in order to allow pressure medium to flow to the working connections A, B.

FIG. 2D shows a first variant of the control piston 20, comprising three axial piston webs 44 having three second openings 37, distributed in the circumferential direction, and comprising two annular grooves 34; in this case, the closing part 42 is symmetrically loaded in the circumferential direction. FIG. 2D' shows a second variant of the control piston 20, comprising only a single second opening 37 and the second annular groove 34.

In this way, the check valve 43, formed by the cooperation of the closing part 42 with the inner casing surface 39 of the control piston 20 at the second openings 37 ("valve openings"), blocks a flow of pressure medium back to the pressure medium connection P. In the direction of the working connections A, B, the action of pressure medium can bring the check valve 43 into an open position in which the two openings 37 are completely opened. Transmission to the pressure medium connection P of the pressure peaks that occur during operation of the internal combustion engine due to alternating moments on the camshaft 3 can be prevented by the check valve 43 if these pressure peaks exceed the pressure present at the pressure medium connection P.

Figure 3A:
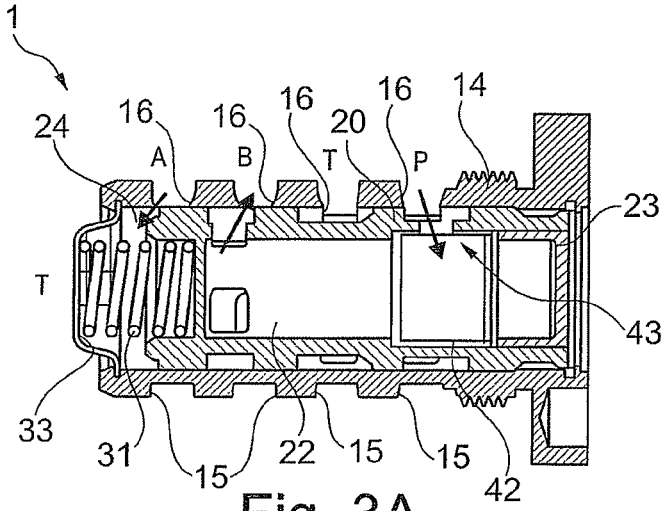
FIGS. 3A-3C are schematic axial sectional views of the control valve of FIG. 1 in three different working positions.

Three different operating positions of control valve 1 are now described with reference to FIGS. 3A through 3C. First, FIG. 3A is considered, in which a first operating position of the control valve 1 is shown in which current does not flow to the magnetic armature of the electromagnet 27, so that the control piston 20 is pressed into its initial position by a helical pressure spring 31. When the pressure medium is pumped through the pressure medium connection P, pressure medium can flow through the second annular groove 34 and the second openings 37 into the piston cavity 22, provided that the closing part 42 is brought into its open position through the action of pressure medium, as is the case given corresponding design of the elastic properties. In this position of control piston 20, the pressure medium flows through third openings 38 and through third annular groove 35 into working connection B. Charging the pressure chambers B via the working connection B impels pressure medium from the pressure chambers A to the working connection A, and the pressure medium flows through the first openings 16 of the connection A to the axial discharge connection $T_2$. This position of the control piston 20 is used to modify a relative position of angular rotation of the outer and inner rotors 4, 5 in the one direction of rotation.

Figure 3B:
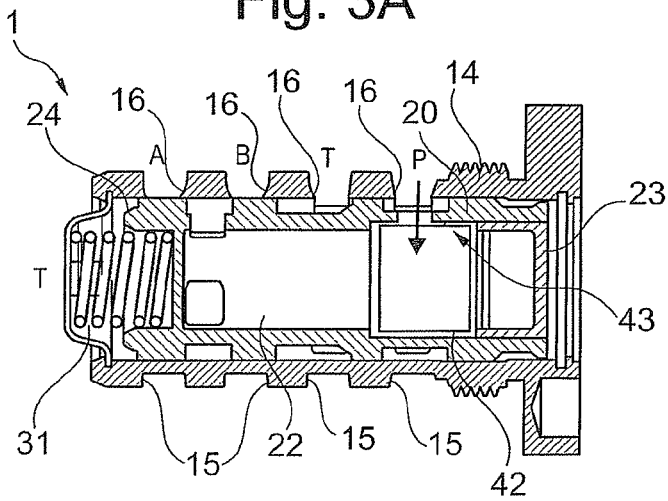

FIG. 3B shows a second working position of the control valve 1, differing from the first working position; in this second position, the magnetic armature of the electromagnet 27 is supplied with current, so that the control piston 20 is moved at least approximately into the center position, against the spring force of the helical pressure spring 31. Here, the first opening 16 of the working connection A is increasingly covered by a first control edge 46 of a first annular web 45 of the control piston 20. In addition, a first opening 16 of the working connection B is increasingly covered by a second control edge 48 of a second annular web 47 of the control piston 20. In the position shown in FIG. 3B, the first openings 16 of working connections A, B are completely covered by the first and second annular webs 45, 47, so that these openings are connected neither to the pressure medium connection P nor to the first or second discharge connections $T_1$, $T_2$. Nonetheless, the pressure medium can flow through the second annular groove 34 and through the second openings 37 into the piston cavity 22, but does not flow into the working connections A, B. Alternatively, the control piston 20 can also be made such that in this position of the control piston 20 the two working connections A, B simultaneously communicate with third annular groove 35, so that the two working connections A, B are simultaneously connected to pressure medium connection P. This position of the control piston 20 is used to fix a relative position of angular rotation of the outer and inner rotor 4, 5.

Figure 3C:
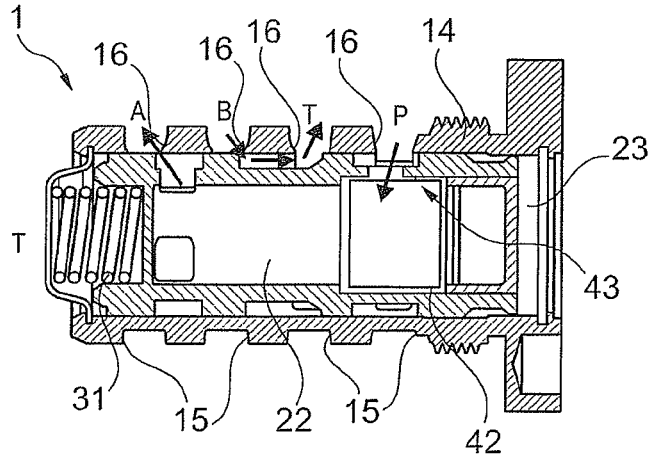

FIG. 3C shows a third working position, differing from the first and second working positions, of the control valve 1, in which more current flows to the magnetic armature of the electromagnet 27, so that the control piston 20 is moved past the center position, against the spring force of the helical pressure spring 31. In this position of the control piston 20, a third control edge 49 of first annular web 45 releases the first openings 16 of the working connection A. In addition, the fourth annular groove 36 communicates both with the working connection B and with the radial discharge connection $T_1$.

Pressure medium can flow through a second annular groove 34 and through the second openings 37 into the piston cavity 22, and can thus flow through the third openings 38 and the third annular groove 35 into the working connection A. By charging the pressure chambers A via the working connection A, pressure medium is impelled out of the pressure chambers B to the working connection B, and, via the first openings 16 and the fourth annular groove 36 of working connection B, flows to the radial discharge connection $T_1$. This position of the control piston 20 is used to modify a relative position of angular rotation of the outer and inner rotor 4, 5 in the other direction of rotation.

Although in the first specific embodiment of the control valve according to the present invention the closing part 42 is located inside the piston cavity 22, it would be equally conceivable to situate the closing part 42 not inside piston cavity 22, but rather, covering the third annular groove 35, on the outer casing surface 50 of the control piston 20. In this case, the closing part 42 would be spirally widened into its open position when charged with pressure through the pressure connection P. On the other hand, when oppositely charged with pressure, the closing part 42 would lie against a valve seat formed by the outer casing surface 50 in the area of the third annular groove 35.

A second exemplary embodiment of the control valve 1 according to the present invention is now described with reference to FIGS. 4A through 4C. In order to avoid unnecessary repetition, only the differences from the first exemplary embodiment are explained; otherwise, reference is made to the statements made there.

Figure 4B:
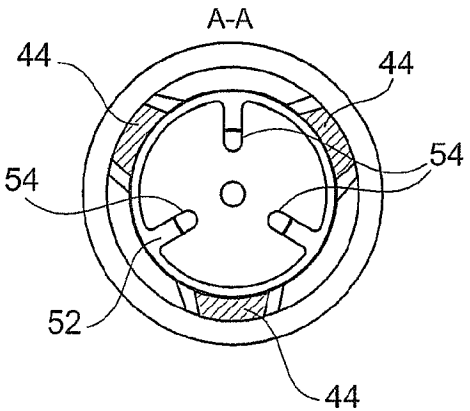
FIGS. 4A-4C are various views of a control piston, as well as a perspective view of insert parts for supporting the closing part, in order to illustrate a second exemplary embodiment of the control valve according to the present invention.
Figure 4A:
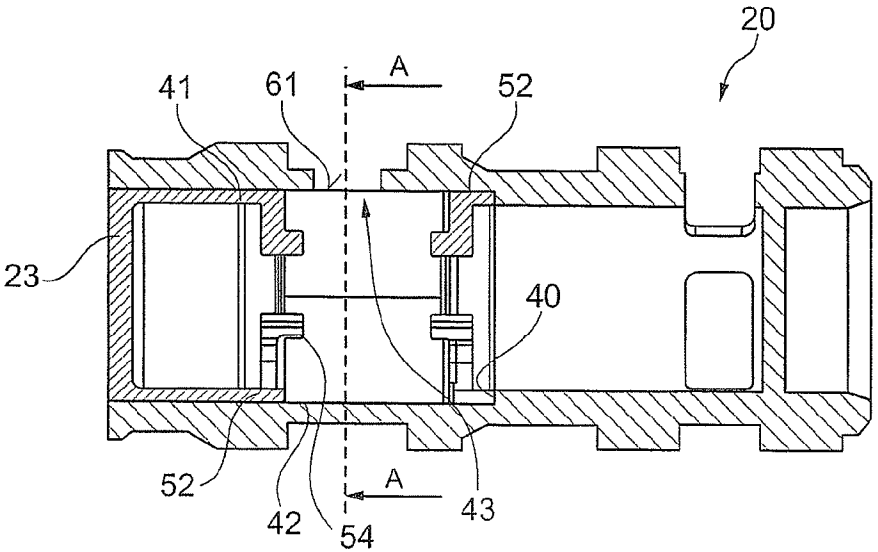
Figure 4C:
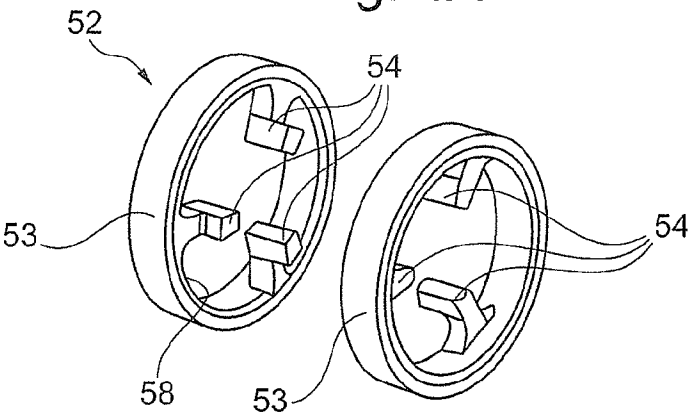

FIG. 4A shows a schematic axial sectional view, and FIG. 4B shows a radial sectional view along sectional line A-A, of the control piston 1. Accordingly, two insert parts 52 are provided for the axial support of the closing part 42, shown in FIG. 4C in a perspective representation. The two insert parts 52 each comprise a ring 53 on which projections 54 are integrally formed that are distributed uniformly in the circumferential direction. The hook-shaped projections 54 extend radially inward and protrude axially relative to a ring end face 58. The two insert parts 52 lie against the third annular step 40 formed by the control piston 20 and against a fourth annular step 41 formed by a pressure piece 23. The closing part 42 is held between these two insert parts 52, where it is supported against ring end faces 58 and is axially secured thereby. The hook-shaped projections 54 of the insert parts 52 are radially inwardly offset relative to the circumferential surface of the cylindrical closing part 42, so that they permit closing part 42 to be made smaller (spiral winding on), up to a determined opening stroke.

The two insert parts 52 can ensure a reliable and secure axial fixing of the closing part 42 even given very high pressure and a large reduction of its radial dimension. The opening stroke of the closing part 42 is limited by the projections 54, located radially inward relative to the closing part 42.

A third exemplary embodiment of a control valve 1 according to the present invention is described with reference to FIGS. 5A through 5D. In order to avoid unnecessary repetition, only the differences from the first exemplary embodiment are explained, and reference is made otherwise to the statements made there.

Figure 5A:
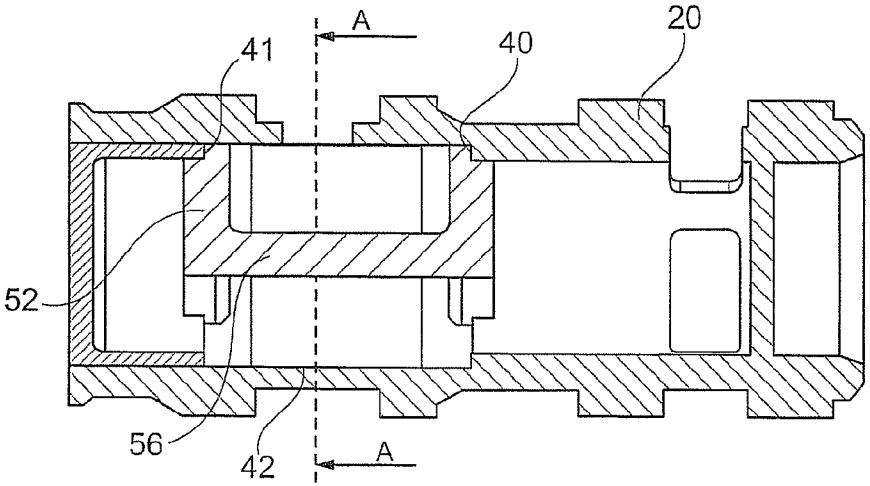
FIGS. 5A-5D are various views of a control piston, as well as a perspective view of an insert part for supporting the closing part, in order to illustrate a third exemplary embodiment of the control valve according to the present invention.
Figure 5B:
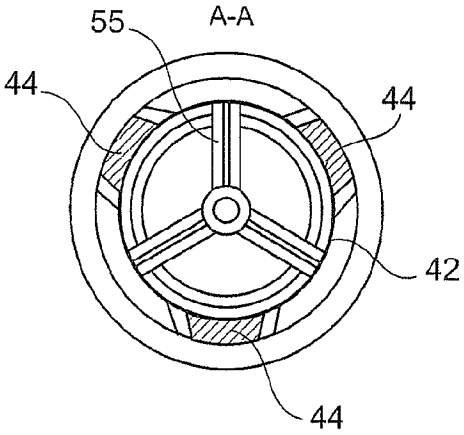
Figure 5C:
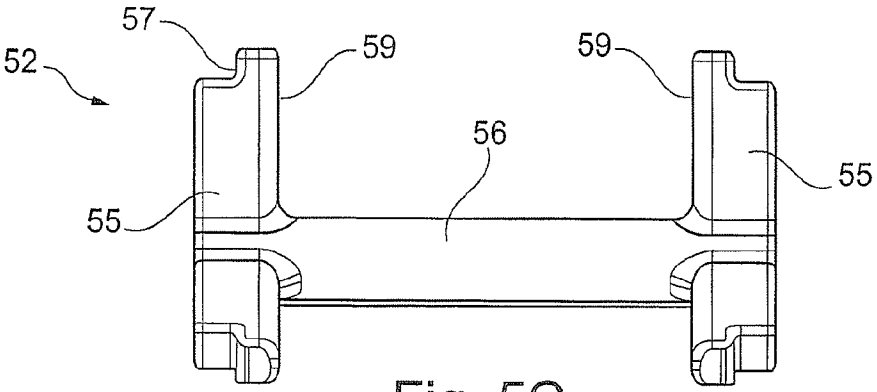
Figure 5D:
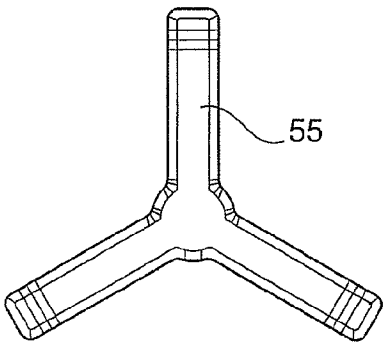

FIG. 5A shows a schematic axial sectional view, and FIG. 5B shows a radial sectional view along sectional line A-A, of the control piston 1. Accordingly, only a single insert part 52 for the axial support of the closing part 42 is provided, shown in FIG. 5C in a perspective side view and in FIG. 5D in a perspective front view. The insert part 52 comprises two segments realized in the form of tripods 55, connected to one another by a respective connecting web 56. A fifth annular step 57 is integrally formed on each of the two tripods 55, and these steps are made so that their shape matches that of third annular step 40 and fourth annular step 41. The two tripods 55 are provided with end surfaces 59 facing one another.

The insert part 52 inserted into the cavity of the control piston 20 is axially secured by the third annular step 40 formed by the control piston 20 and by the fourth annular step formed by the pressure piece 23, with the closing part 42 being held and axially secured between the two end surfaces 59 of the tripods 55.

The insert part 52 can ensure a reliable and secure axial fixing of the closing part 42 even given very high pressure charging or large reduction of its radial dimension. An opening stroke of the closing part 42 is not limited by the insert part 52.

A fourth exemplary embodiment of control valve 1 according to the present invention is described with reference to FIGS. 6A through 6E. In order to avoid unnecessary repetition, only the differences from the first exemplary embodiment are explained, and reference is made otherwise to the statements made there.

Figure 6E:
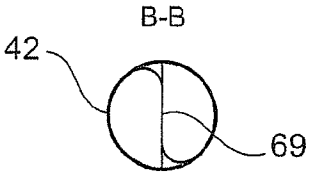
FIGS. 6A-6E are various views of a control piston as well as various views of the closing part in order to illustrate a fourth exemplary embodiment of the control valve according to the present invention.
Figure 6D:
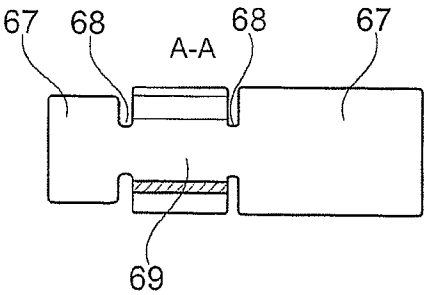
Figure 6C:
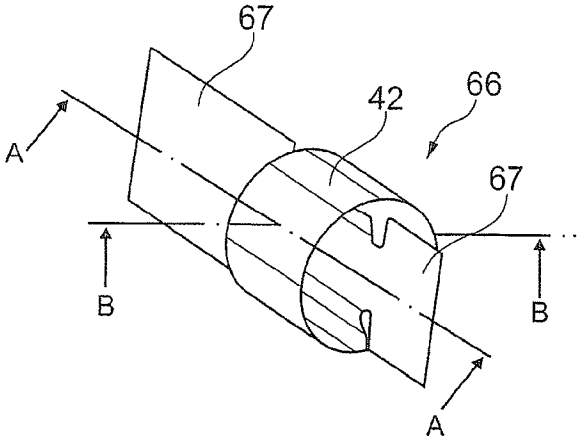
Figure 6B:
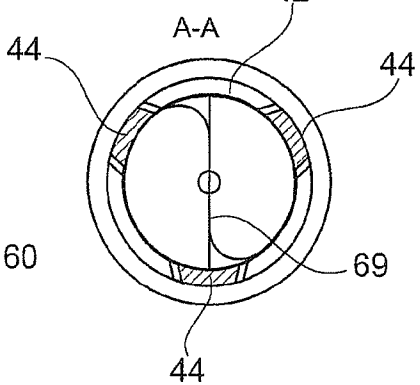
Figure 6A:
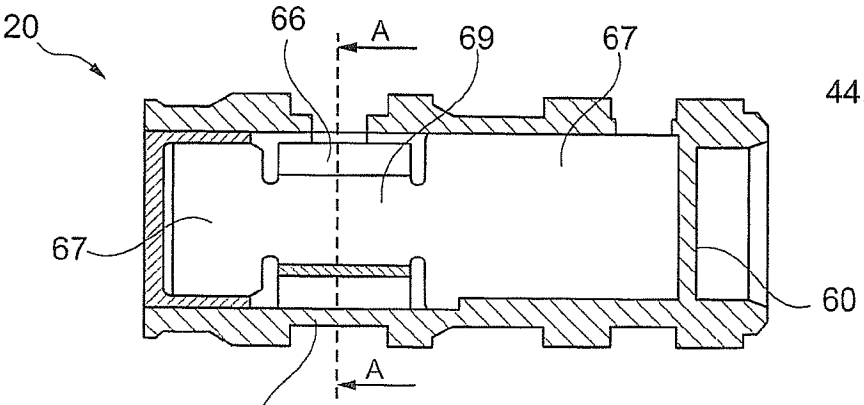

FIG. 6A shows a schematic axial sectional view, and FIG. 6B shows a radial sectional view along sectional line A-A, of the control piston 1. Accordingly, a closing element 66 made of spring steel sheet is provided that is shown in FIG. 6C in a perspective representation and in FIG. 6D in an axial sectional view along sectional line A-A, and in FIG. 6E in a radial sectional view along sectional line B-B. The closing element 66 comprises a closing part 42 having an essentially cylindrical contour produced by spiral winding of a band made of spring steel sheet. An inner end of the closing part 42 is connected to a plate-shaped flat center segment 67 that extends along the axis of the closing part 42. The flat center segment 67 is connected, via two depicted connecting segments 68, to two plate-shaped flat end segments 67, located at both sides outside the closing part 42. The flat center segments 69 and the two flat end segments 67 together form a support segment for the axially fixed support of the closing part 42. The support segments 67, 69 and the closing part 42 together form closing element 66.

In the control valve 1, the closing element 66 is inserted into the piston cavity 22, where the end faces of its two flat end segments 67 coming into contact with the fourth annular step 41, formed by the pressure piece 23, and with the second wall segment 60, element 66 is axially secured in this way. The closing part 42 here assumes a position such that, corresponding to the closing part 42 of the first exemplary embodiment of the present invention, it covers the second openings 37. An outer surface 61 of the closing part 42 cooperates with the inner casing surface 39 of the control piston 20 in such a way that a check valve 43 is formed. A segment of the inner casing surface 39 of the control piston 20 into which the second openings 37 open here acts as a valve seat for the closing part 42, and the outer surface 61, acts as sealing surface, of the closing part 42 lies tightly against the inner casing surface 39 of the control piston 20. In this position of the closing part 42, the check valve 43 is closed for the directed blockage of the flow of pressure medium to the pressure medium connection P (i.e., opposite the direction for conveying pressure medium to the working connections A, B). If the closing part 42 is charged with pressure medium via the pressure medium connection P, then it is spirally wound tighter, reducing its diameter, so that the outer surface 61 is lifted off from the valve seat and the two openings 37 are opened so that pressure medium can flow through them.

In this way, a flow of pressure medium back in the direction toward the pressure medium connection P is blocked by the check valve 43, which is formed at the second openings 37 by the cooperation of the closing part 42 with inner casing surface 39 of the control piston 20. In the direction of the working connections A, B, the closing part 42 can be elastically deformed under the action of pressure medium in such a way that the second openings 36 can be completely opened. A transmission to the pressure medium connection P of pressure peaks occurring during operation of the internal combustion engine due to alternating moments on the camshaft 3 can be prevented by the check valve 43 formed in this manner.

A fifth exemplary embodiment of control valve 1 according to the present invention is described with reference to FIG. 7. In order to avoid unnecessary repetition, only the differences from the fourth exemplary embodiment are explained, and reference is otherwise made to the statements made there.

Figure 7:
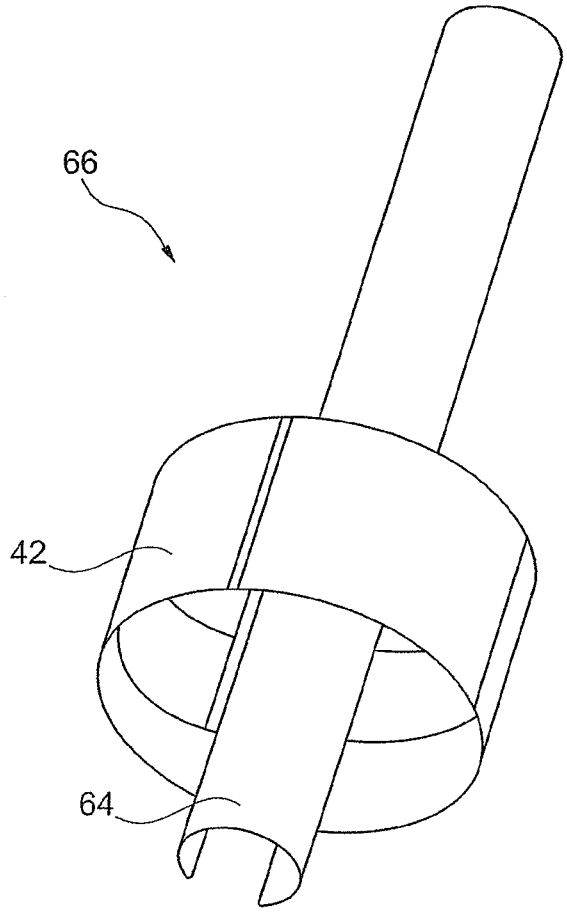
FIG. 7 is a schematic perspective view of the closing part in order to illustrate a fifth exemplary embodiment of the control valve according to the present invention.

FIG. 7 shows a perspective view of the closing element 66. The closing element 66 comprises a closing part 42 having an essentially cylindrical contour produced by spiral winding of a band made of spring steel sheet. An inner end of the closing part 42 goes into a channel segment 64 having an arc-shaped cross section and extending along the axis of the closing part 42.

In the control valve 1, the closing element 66 is inserted into the piston cavity 22, where the end faces of its channel segment 64 come into contact with the fourth annular step 41, formed by the pressure piece 23, and with the second wall segment 60, the element 66 being axially secured in this way. The closing part 42 here assumes a position such that, corresponding to the closing part 42 of the first exemplary embodiment of the present invention, it covers the second openings 37. An outer surface 61 of the closing part 42 cooperates with the inner casing surface 39 of the control piston 20 in such a way that a check valve 43 for the pressure medium connection P is formed. In this way, analogous to the closing part 42 of the fourth exemplary embodiment of the present invention, a check valve 43 is formed for the directed blockage of the flow of pressure medium to the pressure medium connection P.

The first through fourth exemplary embodiments correspond to a control valve according to the first aspect of the present invention.

A fifth exemplary embodiment of the control valve 1 according to the present invention is described with reference to FIGS. 8A and 8B. The fifth exemplary embodiment corresponds to a control valve according to the second aspect of the present invention. In order to avoid unnecessary repetition, only the differences from the first exemplary embodiment are explained, and reference is otherwise made to the statements made there.

Figure 8A:
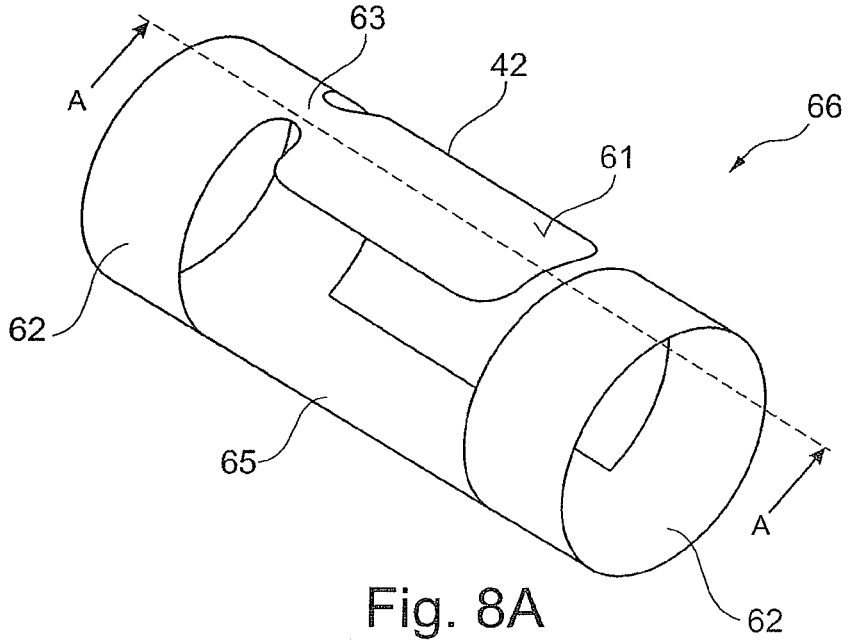
FIGS. 8A-8B are various views of the closing part in order to illustrate a sixth exemplary embodiment of the control valve according to the present invention.
Figure 8B:
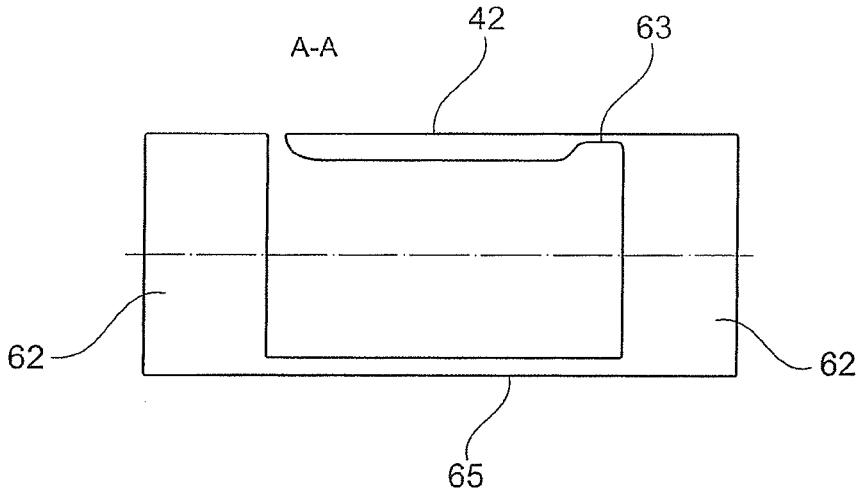

FIG. 8A shows a perspective view, and FIG. 8B shows an axial sectional view along sectional line A-A, of the closing element 66 of the check valve 43. Accordingly, the closing element 66 made of spring steel sheet is provided that comprises two end-located sleeve segments 62 connected to one another by an oblong web segment 65. Opposite the web segment 65, the closing part 42 is integrally formed on one of the two sleeve segments 62 with an essentially rectangular contour, and is mounted in elastically resilient fashion on the sleeve segment 62 via a spring tongue 63.

In control valve 1, the closing element 66 is inserted into the piston cavity 22, where the end faces of its two sleeve segments 62 come into contact with the fourth annular step 41, formed by the pressure piece 23, and with the second wall segment 60, and the element 66 is axially secured in this way. The closing part 42 here assumes a position such that it covers a single second opening 37. In the depicted exemplary embodiment of the closing part 42, only a single closing part 42 is provided, corresponding to a single second opening 37, as is illustrated in FIG. 2B' and FIG. 2D'. However, it is also equally possible for the closing element 66 to have a plurality of the closing parts 42 (e.g. three) that are located such that they cover a plurality of the second openings 37, as illustrated in FIG. 2B and in FIG. 2D.

The closing part 42 of the closing element 66 inserted into the piston cavity 22 cooperates with the inner casing surface 39 of the control piston 20 in such a way that a check valve 43 is formed for the pressure medium connection P. A segment of the inner casing surface 39 of the control piston 20, into which the second opening 37 opens, here acts as the valve seat for the closing part 42, and the outer surface 61, acting as the sealing surface, of the closing part 42 lies tightly against the inner casing surface 39 of the control piston 20. In this position of the closing part 42, the check valve 43 is closed for the directed blockage of the flow of pressure medium to the pressure medium connection P (i.e. opposite the direction for conveying pressure medium to working connections A, B). If the closing part 42 is charged with pressure medium via the pressure medium connection P, the closing part 42 is elastically deflected toward the web segment 65, so that the outer surface 61 is lifted off from the valve seat and the second opening 37 is released so that pressure medium can flow through it.

In this way, a flow of pressure medium back in the direction toward the pressure medium connection P is blocked by the check valve 43, which is formed at the second opening 37 by the cooperation of the closing part 42 with the inner casing surface 39 of the control piston 20. In the direction of the working connections A, B, the closing part 42 can be elastically deflected under the action of pressure medium so that the second opening 36 is completely opened. A transmission to the pressure medium connection P of pressure peaks occurring during operation of the internal combustion engine due to alternating moments on the camshaft 3 can be prevented by the check valve 43 if the pressure peaks exceed the adjacent pressure.

The control valve 1 according to the present invention, having the check valve 43 integrated in the control piston 20, thus advantageously prevents pressure peaks produced due to alternating moments of the camshaft 3 from being further conveyed upstream from the pressure medium connection P, so that further components connected to the pressure medium circuit are protected from such pressure peaks. In addition, the torsional rigidity and positional stability of the rotary piston adjuster 2 is improved. The check valve 43 can easily be produced economically in commercial series production. In particular, significant cost advantages result in comparison with ball check valves as conventionally used. Because the check valve 43 of the control valve 1 according to the present invention completely opens the cross-sections of the two openings 37 even given a relatively small opening stroke, an (undesired) drop in pressure at the check valve 43 is relatively low. Due to the small opening stroke, the check valve 43 is additionally distinguished by fast responsiveness, i.e. short switching times. Different opening and closing characteristics can optionally be set through variation of the band thickness of the closing part 42 made of spring steel sheet. In addition, when the internal combustion engine is shut off, a flow of pressure medium back to the pressure medium connection P via the working connections A, B is prevented. Because the pressure medium, typically oil of the lubrication system, is still for the most part contained in the oil pan when the motor is started, and is not pumped into the oil circuit until the oil pump has been actuated, in this way a sufficient supply of pressure medium can be ensured during operation of the internal combustion engine.

LIST OF REFERENCE CHARACTERS

1 control valve
2 rotary piston adjuster
3 camshaft
4 outer rotor
5 inner rotor
6 chain wheel
7 weld seam
8 cylinder head
9 first side plate
10 second side plate
11 fastening screw
12 first pressure line
13 second pressure line
14 valve housing
15 first annular groove
16 first opening
17 through-hole
18 pressure pump channel
19 first discharge channel
20 control piston
21 first wall segment
22 piston cavity
23 pressure piece
24 housing cavity
25 second discharge channel
26 tappet
27 electromagnet
28 recess
29 flange
30 fastening screw
31 helical pressure spring
32 first annular step
33 second annular step
34 second annular groove
35 third annular groove
36 fourth annular groove
37 second opening
38 third opening
39 inner casing surface
40 third annular step
41 fourth annular step
42 closing part
43 check valve
44 piston web
45 first annular web
46 first control edge
47 second annular web
48 second control edge
49 third control edge
50 control piston outer casing surface
51 valve housing outer casing surface
52 insert part
53 ring
54 projection
55 tripod
56 connecting strut
57 fifth annular step
58 annular end face
59 end face
60 second wall segment
61 outer surface
62 sleeve segment
63 spring tongue
64 channel segment
65 web segment
66 closing element
67 flat end segment
68 connecting segment
69 flat center segment

The invention claimed is:

1. A control valve for controlling pressure medium flows, comprising:

a valve housing having a hollow construction and having at least one feed connection (P), at least two working connections (A, B), and at least one discharge connection (T1, T2), a control piston guided displaceably inside the valve housing, by which, dependent on position, the feed connection (P) is connectable via at least one first pressure medium line to one or the other of the working connections (A, B), while the respective other of the working connections (B, A) is connected via at least one second pressure medium line to the discharge connection (T1, T2), the control piston having a piston cavity and the first pressure medium line comprising a feed opening allocated to the feed connection (P) and comprising a discharge opening allocated to the working connections (A, B), each opening into the piston cavity, at least one check valve that is hydraulically openable and that releases the first pressure medium line in a feed direction, having a closing part that has a sealing surface, by which at least one of the valve openings can be sealed, the closing part is elastically deformable and the sealing surface is movable through elastic deformation of the closing part into a closed position in which the sealing surface lies tightly against the valve opening and an open position in which the valve opening is completely open, and one of the openings of the control piston acts as the valve opening, and the closing part is located in the piston cavity, and the feed opening of the control piston acts as the valve opening.

2. The control valve as recited in claim 1, wherein the closing part is constructed as a spirally wound band.

3. The control valve as recited in claim 1, wherein an inner casing surface of the piston cavity is provided with at least one axial step for axial support of the closing part.

4. The control valve as recited in claim 1, wherein at least one insert part axially supporting the closing part is located in the piston cavity.

5. The control valve as recited in claim 4, wherein the at least one insert part is provided with a means for limiting an opening stroke of the closing part.

6. The control valve as recited in claim 1, wherein the closing part is part of a closing element having a support segment integrally formed on the closing part for axial support of the closing part in the control piston.

7. The control valve as recited in claim 6, wherein the closing part is supported by a support segment on oppositely located wall segments of the control piston.

8. The control valve as recited in one claim 1, wherein the closing part is made of spring steel sheet.

9. The control valve as recited in claim 8, wherein a plate thickness of the spring steel sheet is in a range of 0.05-0.15 mm.

10. A device for modifying the control times of an internal combustion engine having a control valve as recited in claim 1.

11. An internal combustion engine having at least one device for modifying the control times of an internal combustion engine as recited in claim 10.

12. A control valve for controlling pressure medium flows, comprising:

a valve housing having a hollow construction and having at least one feed connection (P), at least two working connections (A, B), and at least one discharge connection (T1, T2), a control piston guided displaceably inside the valve housing, by which, dependent on position, the feed connection (P) is connectable via at least one first pressure medium line to one or the other of the working connections (A, B), while the respective other one of the working connections (B, A) is connected via at least one second pressure medium line to the discharge connection (T1, T2), the control piston having a piston cavity and the first pressure medium line comprising a feed opening allocated to the feed connection (P) and comprising a discharge opening allocated to the working connections (A, B), each opening into the piston cavity, at least one check valve that is hydraulically openable and that releases the first pressure medium line in a feed direction, having a closing part that has a sealing surface, by which at least one of the valve openings can be sealed, the closing part is resiliently supported via at least one spring tongue, the sealing surface of said closing part being movable through elastic deformation of the spring tongue into a closed position in which the spring tongue lies tightly against the valve opening and an open position in which the valve opening is completely open, and one of the openings of the control piston acts as valve opening, and the closing part is located in the piston cavity, and the feed opening of the control piston acts as the valve opening.

13. A control valve for controlling pressure medium flows, comprising:

a valve housing having a hollow construction and having at least one feed connection (P), at least two working connections (A, B), and at least one discharge connection (T1, T2), a control piston guided displaceably inside the valve housing, by which, dependent on position, the feed connection (P) is connectable via at least one first pressure medium line to one or the other of the working connections (A, B), while the respective other of the working connections (B, A) is connected via at least one second pressure medium line to the discharge connection (T1, T2), the control piston having a piston cavity and the first pressure medium line comprising a feed opening allocated to the feed connection (P) and comprising a discharge opening allocated to the working connections (A, B), each opening into the piston cavity, at least one check valve that is hydraulically openable and that releases the first pressure medium line in a feed direction, having a closing part that has a sealing surface, by which at least one of the valve openings can be sealed, the closing part is elastically deformable and the sealing surface is movable through elastic deformation of the closing part into a closed position in which the sealing surface lies tightly against the valve opening and an open position in which the valve opening is completely open, and one of the openings of the control piston acts as the valve opening, and the closing part is located on an outer casing surface of the control piston, and the discharge opening of the control piston acts as the valve opening.

14. A control valve for controlling pressure medium flows, comprising:

a valve housing having a hollow construction and having at least one feed connection (P), at least two working connections (A, B), and at least one discharge connection (T1, T2), a control piston guided displaceably inside the valve housing, by which, dependent on position, the feed connection (P) is connectable via at least one first pressure medium line to one or the other of the working connections (A, B), while the respective other one of the working connections (B, A) is connected via at least one second pressure medium line to the discharge connection (T1, T2), the control piston having a piston cavity and the first pressure medium line comprising a feed opening allocated to the feed connection (P) and comprising a discharge opening allocated to the working connections (A, B), each opening into the piston cavity, at least one check valve that is hydraulically openable and that releases the first pressure medium line in a feed direction, having a closing part that has a sealing surface, by which at least one of the valve openings can be sealed, the closing part is resiliently supported via at least one spring tongue, the sealing surface of said closing part being movable through elastic deformation of the spring tongue into a closed position in which the spring tongue lies tightly against the valve opening and an open position in which the valve opening is completely open, and one of the openings of the control piston acts as valve opening, and the closing part is located on an outer casing surface of the control piston, and the discharge opening of the control piston acts as the valve opening.

* * * * *